US005770354A

United States Patent [19]

Massirio et al.

[11] Patent Number: 5,770,354

[45] Date of Patent: Jun. 23, 1998

[54] SILVER HALIDE PHOTOGRAPHIC ELEMENTS HAVING IMPROVED SENSITIVITY

[75] Inventors: Sergio Massirio, Finale Ligure; Raffaella Biavasco; Flavio Costa, both of Savona, all of Italy

[73] Assignee: Imation Corp., Oakdale, Minn.

[21] Appl. No.: 635,180

[22] Filed: Apr. 25, 1996

[30] Foreign Application Priority Data

Jun. 6, 1995 [EP] European Pat. Off. ..... 95108591

[51] Int. Cl.[6] ..... G03C 1/46

[52] U.S. Cl. ..... 430/506; 430/504; 430/503; 430/509; 430/549; 430/552; 430/556; 430/557

[58] Field of Search ..... 430/502, 503, 430/504, 506, 509, 549, 552, 556, 557

[56] References Cited

U.S. PATENT DOCUMENTS

| | | | |
|---|---|---|---|
| 3,692,833 | 9/1972 | Guzzi et al. | 260/559 |
| 4,184,876 | 1/1980 | Eeles et al. | 430/505 |
| 4,647,527 | 3/1987 | Ikenoue et al. | 430/506 |
| 4,724,198 | 2/1988 | Yamada et al. | 430/506 |
| 4,746,599 | 5/1988 | Deguchi et al. | 430/504 |
| 5,077,182 | 12/1991 | Sasaki et al. | 430/504 |
| 5,258,271 | 11/1993 | Haijima et al. | 430/503 |
| 5,302,500 | 4/1994 | Irie et al. | 430/505 |
| 5,399,468 | 3/1995 | Sawyer et al. | 430/506 |

FOREIGN PATENT DOCUMENTS

| | | |
|---|---|---|
| 0 161 626 | 11/1985 | European Pat. Off. . |
| 0 434 043 A1 | 6/1991 | European Pat. Off. . |
| 0 474 166 A1 | 3/1992 | European Pat. Off. . |
| 0 564 867 a1 | 10/1993 | European Pat. Off. . |
| 0 583 020 A2 | 2/1994 | European Pat. Off. . |

OTHER PUBLICATIONS

Abstract of Japanese patent publication No. JP 050571, Mar. 16, 1984.

*Primary Examiner*—Geraldine Letscher
*Attorney, Agent, or Firm*—Gregory Evearitt; Arlene K. Musser

[57] ABSTRACT

Silver halide photographic element comprising a support having coated thereon red-, green- and blue-sensitive silver halide emulsion layers comprising, respectively, cyan, magenta and yellow dye-forming couplers, wherein the blue-sensitive emulsion layer comprises at least two blue-sensitive emulsion layers, the uppermost of which has the highest-sensitivity and the lowermost of which has the lowest sensitivity, characterized in that the uppermost highest sensitivity blue-sensitive silver halide emulsion layer comprises a yellow dye-forming coupler and a cyan dye-forming coupler.

9 Claims, 1 Drawing Sheet

SILVER HALIDE PHOTOGRAPHIC ELEMENTS HAVING IMPROVED SENSITIVITY

FIELD OF THE INVENTION

The present invention relates to multilayer silver halide color photographic elements. More particularly, the present invention relates to multilayer silver halide color photographic elements having improved sensitivity.

BACKGROUND OF THE INVENTION

Color photographic elements generally are composed of a supporting base having thereon a red-sensitive silver halide emulsion layer containing cyan dye-forming couplers, a green sensitive silver halide emulsion layer containing magenta dye-forming couplers and a blue-sensitive silver halide emulsion layer containing yellow dye-forming couplers, wherein cyan, magenta and yellow dye images are respectively formed upon exposure and color development with aromatic primary amino developing agents.

In particular, color camera films (both negative and reversal films) are prepared by coating on the supporting base (such as cellulose triacetate film, polyethylene terephthalate film, polyethylene naphthalate film, and the like) an antihalation layer, a red-sensitive layer, a green-sensitive layer, a yellow filter layer and a blue-sensitive layer.

The silver halide emulsions used in the past for such photographic elements were the so-called mixed emulsions, that is, emulsions comprising a combination of a more sensitive emulsion (containing coarse silver halide grains) and a less sensitive emulsion (containing fine silver halide grains) whereby a straight density-log exposure curve could be obtained for each blue-, green- and red-sensitive layer.

Since granularity of the dye image in color photographic elements depends mainly upon the size of the silver halide grains employed, attempts to increase the sensitivity of the color photographic material by increasing the size of the silver halide grains (sensitivity of silver halide grains generally is proportional to the size of the silver halide grains) caused a coarsening of the granularity of the dye image.

As a method for improving sensitivity, a technique has been known in which the regular layer sequence having respective red-sensitive, green-sensitive and blue-sensitive silver halide emulsion layers is provided by subdividing a part or whole of the emulsion layers for each color into higher and lower sensitivity emulsion layers, each subdivided layer containing a color coupler forming substantially the same hue as the other subdivided layers for the same color formation and wherein these layers are coated adjacent to each other.

For example, GB 923,045 describes a method for increasing the sensitivity of a color photographic element without coarsening the granularity of the dye image by providing an uppermost more sensitive emulsion layer and a lowermost less sensitive emulsion layer, sensitive to the same region of the visible spectrum and each containing non-diffusing color couplers, with the maximum color density of the more sensitive emulsion layer being adjusted to be lower than that of the less sensitive emulsion layer, in particular from 0.20 to 0.60.

U.S. Pat. No. 3,843,369 describes a method for further increasing the sensitivity of a color photographic element by providing three emulsion layers sensitive to the same spectral region of visible light, the uppermost silver halide emulsion layer having the highest light sensitivity and the lowermost silver halide emulsion layer having the lowest light sensitivity, the uppermost and the intermediate layer each having a maximum density of 0.6 or less.

U.S. Pat. No. 4,582,780 describes a method for increasing sensitivity and improving adjacency effects by providing three emulsion layers sensitive to the same spectral region of visible light, the uppermost silver halide emulsion layer having the highest light sensitivity and the lowermost silver halide emulsion layer having the lowest light sensitivity, wherein the maximum color density of the uppermost silver halide emulsion layer, after color development, is lower than 0.60 and the maximum color densities of both the intermediate and the lowermost silver halide emulsion layers, after color development, are each higher than 0.60.

According to such techniques, there is still the problem that the emulsion layer on the side nearer to the support, namely the red-sensitive layer, may suffer from absorption of the light by other emulsions layers positioned on the side farther from the support during exposure. Moreover, during development, a considerably long time is required for diffusion of a developer. Thus, according to such a layer sequence, due to loss in exposure and delay in development, it is difficult to achieve higher sensitivity in red-sensitive emulsion layers.

On the other hand, techniques to alter the regular silver halide emulsion layer sequence are also known. For example, U.S. Pat. Nos. 4,184,876, 4,724,198, 4,977,069 and EP 583,020 disclose layer sequences wherein the most sensitive red-sensitive silver halide emulsion layer is coated farther from the support than least sensitive green-sensitive or blue-sensitive emulsion layers. However, any of these techniques, while providing higher sensitivity than the regular layer sequence, are unsatisfactory as image quality is worsened and additional interlayers are required to reduce unwanted migration of oxidized developer during processing.

U.S. Pat. No. 4,806,459 discloses a color photographic material wherein a blue-sensitive silver halide emulsion layer contains a yellow dye-forming coupler, a cyan dye-forming coupler and a DIR (Development Inhibitor Releasing) coupler present in the same lowermost lowest sensitivity blue-sensitive layer to improve reproducibility of the yellow-green color.

U.S. Pat. No. 5,077,182 discloses a color photographic material comprising blue-, green- and red-sensitive layers having specific spectral sensitivity ranges, the blue-sensitive layers comprise a yellow coupler and a cyan coupler or a cyan DIR coupler, and the material further satisfies other requirements to improve color-reproducibility. In the example, the cyan coupler is contained in the lowermost lowest sensitivity blue-sensitive layer.

U.S. Pat. No. 5,302,500 discloses a color photographic material which displays improved reproducibility of green color as well as orange and sky blue color. The material comprises blue-, green- and red-sensitive layers having specific spectral sensitivity ranges and the blue-sensitive layer comprises a yellow dye-forming coupler and a cyan dye-forming coupler. In the examples, the cyan coupler is contained in the lowermost lowest sensitivity blue-sensitive layer.

U.S. Pat. No. 5,258,271 discloses a color photographic material having a silver halide emulsion layer which comprises a specific yellow dye-forming coupler and a quenching coupler selected from the group consisting of a cyan dye-forming coupler and a magenta dye-forming coupler or a quenching dye obtained by a coupling reaction of the above couplers. The purpose is to provide a color photographic material excellent in yellow dye fastness under dark storage and light irradiation. In the examples, the cyan dye-forming coupler is included in the uppermost highest sensitivity and in the lowermost lowest sensitivity blue-sensitive layer.

A further problem associated with high sensitivity color photographic elements is that of reducing variations in color reproduction caused by the use of different light sources in taking pictures. Therefore, it is not easy to obtain a single color element which provides acceptable color balance upon exposure to daylight, tungsten or fluorescent illumination. Usually color photographic elements are balanced differently to give an average effect upon exposure to a specific illumination. U.S. Pat. No. 3,672,898 teaches spectral responses that are appropriate for reducing such variations in color reproduction by bringing the spectral responses of blue- and red-sensitive layers closer to that of a green-sensitive layer. A problem with this solution is that it creates an overlapping in the spectral sensitivity curves which lowers the purity of colors.

SUMMARY OF THE INVENTION

The present invention relates to a multilayer color photographic element comprising a support having coated thereon red-, green- and blue-sensitive silver halide emulsion layers comprising, respectively, cyan, magenta and yellow dye-forming couplers, wherein the blue-sensitive emulsion layer comprises at least two blue-sensitive emulsion layers, the uppermost of which has the highest sensitivity and the lowermost of which has the lowest sensitivity, characterized in that the uppermost highest sensitivity blue-sensitive silver halide emulsion layer comprises a yellow dye-forming coupler and the cyan dye-forming coupler represented by formula (I) below.

The color photographic elements containing the combination of a yellow dye-forming coupler and the cyan dye-forming coupler of formula (I) in the uppermost highest sensitivity blue-sensitive silver halide emulsion layer provide increased sensitivity and less variability in color balance upon exposure to different illuminations.

DETAILED DESCRIPTION OF THE INVENTION

Figure 1:
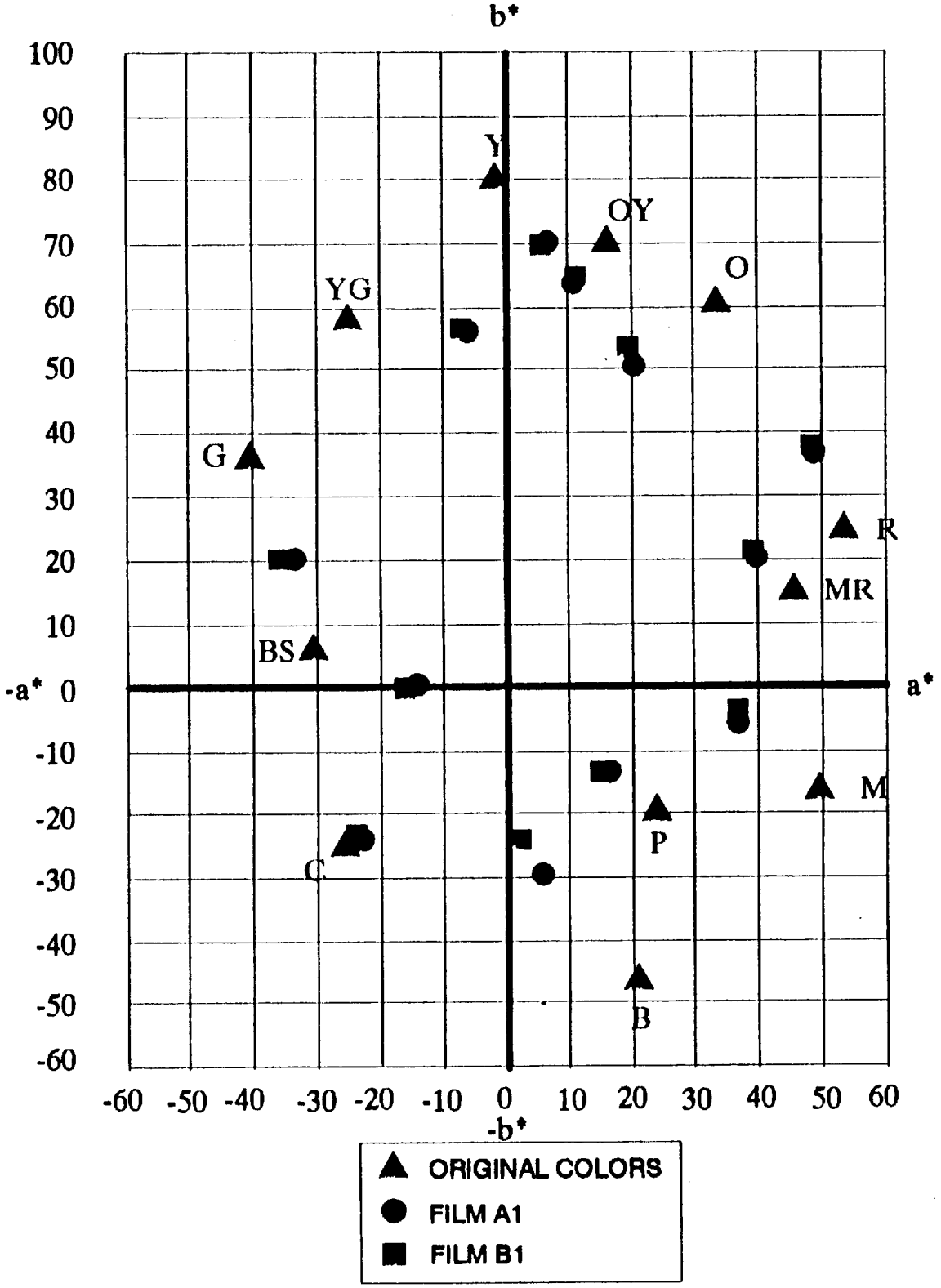
FIG. 1 shows a chromaticity diagram showing reproduced areas of resulting color prints versus the original colors.

A cyan dye-forming coupler to be contained in an uppermost highest sensitivity blue-sensitive silver halide emulsion layer is represented by the formula (I):

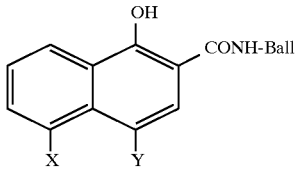

(I)

wherein Ball is a ballasting group, Y represents a halogen atom, such as chlorine, bromine and fluorine, and is preferably chlorine, and X represents a hydrogen atom or a group ZH wherein Z is an oxygen atom, a sulfur atom or

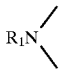

wherein $R_1$ represents a hydrogen atom or a monovalent organic group having from 1 to 30 carbon atoms.

In the above formula, "Ball" is a ballasting group, i.e., an organic group of such size and configuration as to render a group to which is attached non-diffusible from the layer in which it is coated in a photographic element. Said ballasting group may include an organic hydrophobic residue having 8 to 32 carbon atoms bonded to the coupler either directly or through a divalent linking group such as, for example, an alkylene, imino, ether, thioether, carbonamido, sulfonamido, ureido, ester, imido, carbamoyl, and sulfamoyl group. Specific examples of suitable ballasting groups include alkyl groups (linear, branched, or cyclic), alkenyl groups, alkoxy groups, alkylaryl groups, alkylaryloxy groups, acylamidoalkyl groups, alkoxyalkyl groups, alkoxyaryl groups, alkyl groups substituted with an aryl group or a heterocyclic group, aryl groups substituted with an aryloxyalkoxycarbonyl group, and residues containing both an alkenyl or alkenyl long-chain aliphatic group and a carboxy or sulfo water-soluble group, as described, for example, in U.S. Pat. Nos. 3,337,344, 3,418,129, 4,138,258, and 4,451,559, and in GB 1,494,777.

The monovalent organic group within Z as represented by $R_1$ is preferably represented by the formula

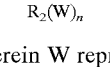

wherein W represents an imino group, a carbonyl group or a sulfonyl group, n represents 0 or 1, and $R_2$ represents a hydrogen atom, an aliphatic group having from 1 to 30 carbon atoms, an aromatic group having from 6 to 30 carbon atoms, a heterocyclic group having from 2 to 30 carbon atoms, a hydroxyl group, —$OR_3$, —$COR_3$, —$SO_2R_3$ or

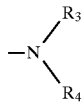

wherein $R_3$ and $R_4$ (which may be the same or different) each represents an aliphatic group having from 1 to 12 carbon atoms, an aromatic group having from 6 to 10 carbon atoms, or a heterocyclic group having from 2 to 10 carbon atoms, or $R_3$ and $R_4$ can together form a nitrogen-containing heterocyclic ring (e.g., a morpholino ring, a piperidino ring, or a pyrrolidino ring).

Z preferably represents

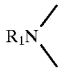

wherein $R_1$ includes —$COR_2$ (e.g., a formyl group, an acetyl group, chloroacetyl group, a benzoyl group, etc.), —$COOR_3$ (e.g., a methoxycarbonyl group, an ethoxycarbonyl group, a phenoxycarbonyl group, etc.), —$SO_2R_2$ (e.g., a methanesulfonyl group, an ethanesulfonyl group, a benzene-sulfonyl group, a toluenesulfonyl group, etc.), —$CONR_3R_4$ (e.g., an N,N-di-methylcarbamoyl group, an N,N-diethylcarbamoyl group, a morpholinocarbonyl group, a 3,4-dichlorophenylcarbamoyl group, etc.), and —$SO2NR_3R_4$ (e.g., an N,N-dimethylsulfamoyl group, an N,N-dipropylsulfamoyl group, etc.), wherein $R_2$, $R_3$ and $R_4$ are the same as described above.

When the term "group", "ring" or "residue" is used in this invention to describe a chemical compound or substituent, the described chemical material includes the basic group, ring or residue and that group, ring or residue with conventional substitution. Where the term "moiety" is used to describe a chemical compound or substituent, only the unsubstituted chemical material is intended to be included. For example, "alkyl group" includes not only such alkyl moiety as methyl, ethyl, butyl, octyl, stearyl, etc., but also moieties bearing substituent groups such as halogen cyano, hydroxyl, nitro, amino, carboxylate, etc. On the other hand, "alkyl moiety" includes only methyl, ethyl, stearyl, cyclohexyl, etc.

Specific examples of cyan dye-forming couplers for use in the present invention are illustrated below, but the present invention should not be construed as being limited thereto.

(I-1)

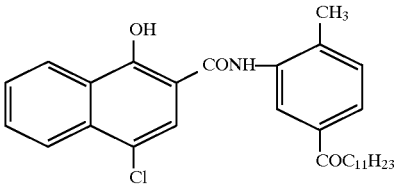

(I-2)

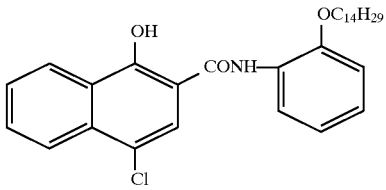

(I-3)

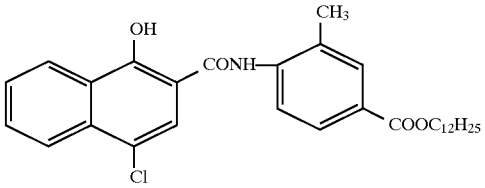

(I-4)

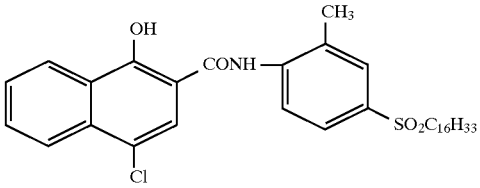

(I-5)

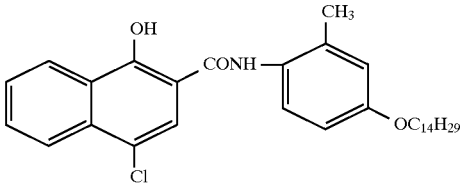

(I-6)

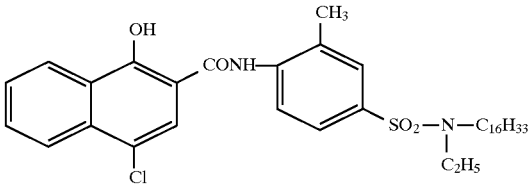

-continued (I-7)

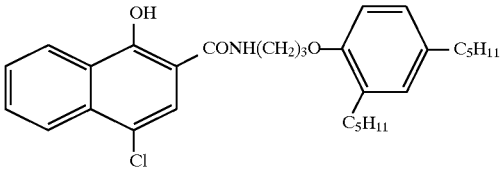

(I-8)

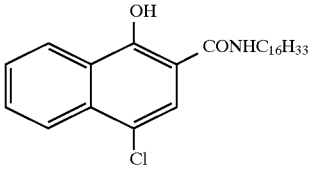

(I-9)

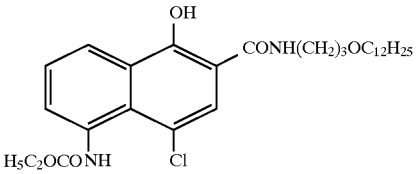

(I-10)

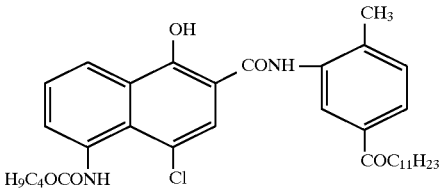

The yellow dye-forming couplers to be used in the present invention include the oil protection type acylacetainide couplers. Specific examples thereof are described in U.S. Pat. Nos. 2,407,210, 2,875,057, 3,265,506, etc. In the present invention, the use of two-equivalent couplers is preferable, and typical examples thereof include yellow couplers wherein the splitting-off group is attached through an oxygen atom, such as those described in U.S. Pat. Nos. 3,408,194, 3,447,928, 3,933,501 and 4,022,620 and yellow couplers wherein the splitting-off group is attached through a nitrogen atom, such as those described in U.S. Pat. Nos. 4,401,752 and 4,326,024, RD 18053 (April 1979), GB 1,425,020, and in DE 2,219,917, 2,261,361, 2,329,587 and 2,433,812. Among these couplers, α-pivaloylacetanilide type couplers are excellent in fastness of color dyes, whereas α-benzoylacetanilide type couplers provide high color density.

Yellow dye-forming couplers particularly preferable in the present invention are alkoxybenzoylacetanilide couplers represented by the general formula (II):

(II)

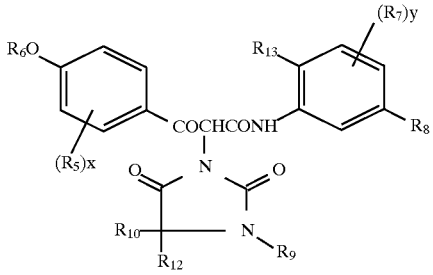

wherein $R_5$ and $R_7$, equal or different, each represents an alkyl group having 1 to 4 carbon atoms (such as methyl, ethyl, propyl, butyl, chloroinethyl, trifluoroinethyl, etc.), aryl group preferable having 6 to 12 carbon atoms (such as phenyl, benzyl, tolyl, etc.), halogen atom (such as chlorine, bromine, etc.) or alkoxy group preferably having 1 to 15 carbon atoms (such as methoxy, isopropoxy, octyloxy, etc.); x and y are individually 0, 1 or 2; $R_6$ is an alkyl group having 1 to 4 carbon atoms (such as methyl, ethyl, propyl, butyl, chloromethyl, trifluoromethyl, etc.); $R_8$ is a ballast group as defined in formula (I); Rg represents a hydrogen atom, an alkyl group (such as methyl, ethyl, propyl, isopropyl, amyl, isoamyl, hexyl, carboxymethyl, hexadecyl, etc.), an aryl group (such as phenyl, naphthyl, etc.) or an acyl group (such as acetyl, propionyl, octanoyl, benzoyl, etc.); $R_{10}$ is a hydrogen atom, an alkyl group (such as methyl, ethyl, propyl, isopropyl, amyl, isoamyl, hexyl, carboxymethyl, hexadecyl, etc.), —O—$R_{11}$ or —S—$R_{11}$ wherein $R_{11}$ is a hydrogen atom, an alkyl group (such as methyl, ethyl, propyl, isopropyl, amyl, isoamyl, hexyl, carboxymethyl, hexadecyl, etc.), an aryl group (such as phenyl, naphthyl, etc.), a heterocyclic group bonded to the oxygen or sulfur atom through one carbon forming said heterocyclic group (such as 2-tetrahydropyranyl, 2-pyridyl, 4-pyridyl, etc.), or an acyl group (such as acetyl, propionyl, octanoyl, benzoyl, etc.); R12 is a hydrogen atom, an alkyl group (such as methyl, ethyl, propyl, isopropyl, amyl, isoamyl, hexyl, carboxymethyl, hexadecyl, etc.), or an aryl group (such as phenyl, naphthyl, etc.); $R_{13}$ is a halogen atom (such as chlorine, bromine, etc.) or an alkoxy group having 1 to 15 carbon atoms (such as methoxy, chloromethoxy, ethoxy, butoxy, etc.).

In particular, in the present invention, preferred alkoxybenzoylacetanilide yellow dye-forming couplers are represented by the general formula (III):

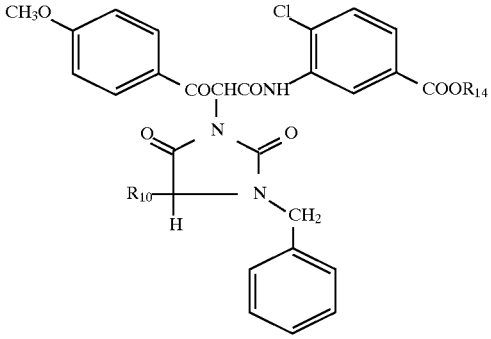

(III)

wherein $R_{10}$ is the same as in formula (II) and $R_{14}$ is an alkyl group having 8 to 32 carbon atoms.

Specific examples of alkoxybenzoylacetanilide yellow dye-forming couplers for use in the present invention are given below as illustrative examples.

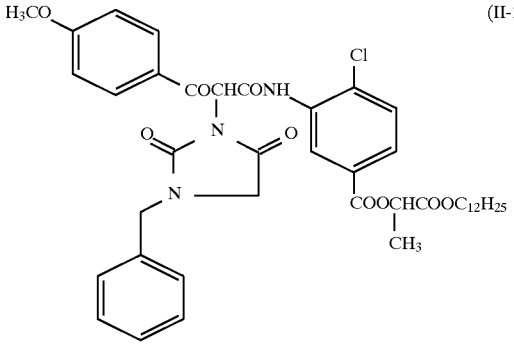

(II-1)

-continued

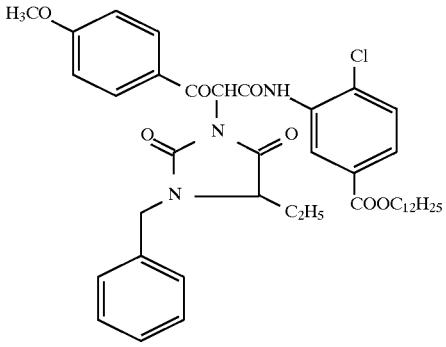

(II-2)

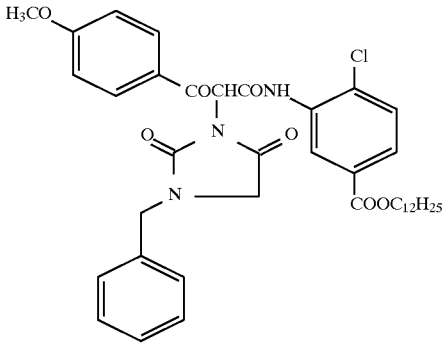

(II-3)

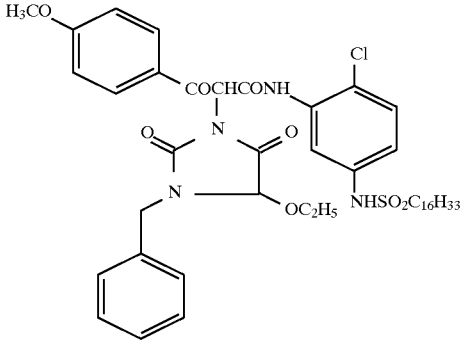

(II-4)

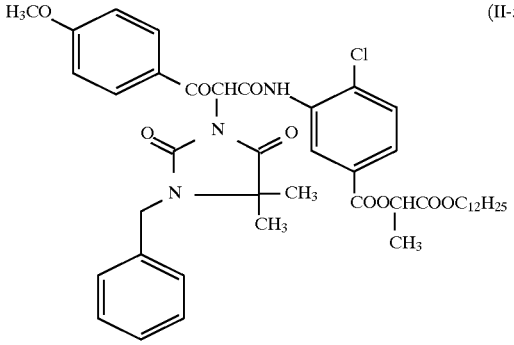

(II-5)

-continued (II-6)

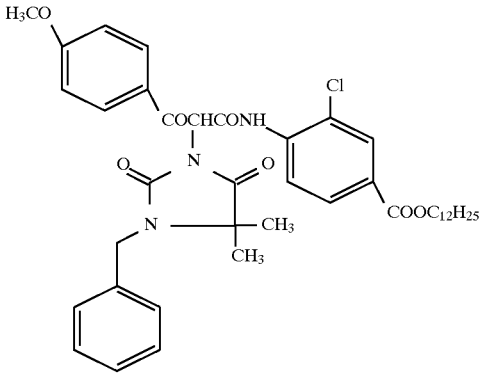

(II-7)

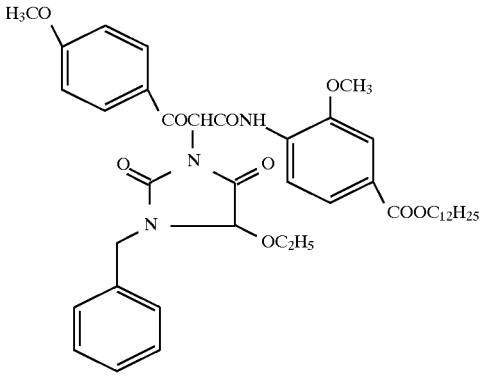

(II-8)

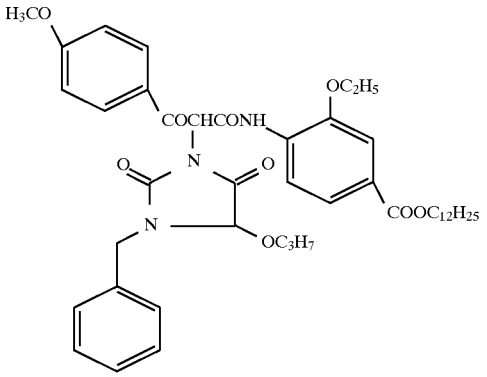

(II-9)

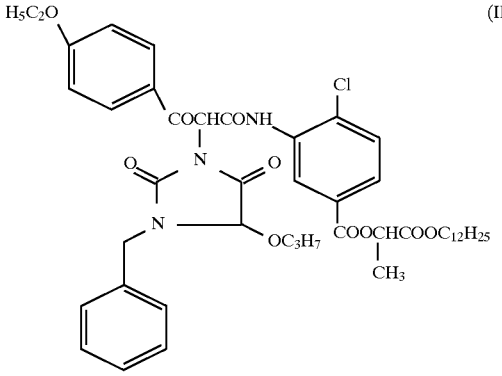

-continued (II-9)

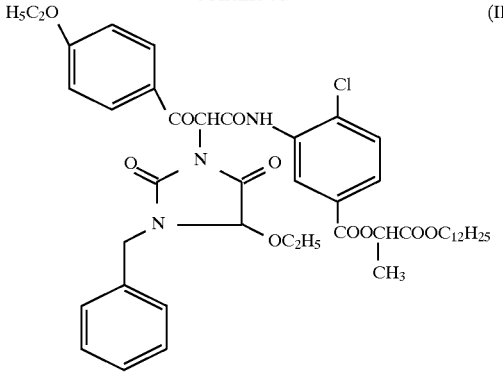

In the present invention, the blue-sensitive layer is composed of two or more silver halide emulsion layers sensitized to the same spectral region of the visible spectrum, the uppermost silver halide emulsion layer having the highest sensitivity and the lowermost silver halide emulsion layer having the lowest sensitivity, as described in GB 923,045, U.S. Pat. No. 3,843,369 and U.S. Pat. No. 4,582,780. The two or more silver halide emulsions are arranged so that light travels through the uppermost highest sensitivity blue-sensitive layer before striking the lowermost lowest sensitivity blue-sensitive layer. The difference in sensitivity between the highest and the lowest blue-sensitive layers, as referred to herein, is preferably such that extended latitude in the photographic element is achieved without an appreciable distortion of the shape of the sensitometric curve. Generally, this difference in sensitivity should be within the range of from about 0.2 to about 1 logE (E being exposure) and preferably will be about 0.5 logE. Also, the uppermost highest sensitivity blue-sensitive emulsion layer produces upon development a colored image of lower color density than the lowermost lowest sensitivity blue-sensitive emulsion layer. Generally, the uppermost highest sensitivity blue-sensitive emulsion layer is relatively "starved" with respect to its color coupler content in order to improve granularity of this layer (as disclosed by GB 923,045). That is, relatively smaller amounts of coupler are used in the highest sensitivity layer, such that, upon exposure and development, this layer produces a colored image which is less dense by at least 1.0 optical density units than that produced in the lowest sensitivity layer.

In the present invention, the uppermost highest sensitivity blue-sensitive silver halide emulsion layer comprises the yellow dye-forming coupler and the cyan dye-forming coupler as described above. In this layer, the yellow dye-forming coupler is used in an amount ranging from 0.01 to 0.5 mol per mol of silver halide, preferably 0.02 to 0.1 mol, and the cyan coupler is used in an amount of 0.001 to 0.1 mol per mol of silver halide, preferably 0.002 to 0.01 mol. To improve granularity, the uppermost highest sensitivity blue-sensitive silver halide emulsion layer can contain DIR (Development Inhibitor Releasing) couplers incorporated therein or in an adjacent layer. In this case, the DIR couplers are employed in an amount of 0.001 to 0.1 mol per mol of silver halide, preferably 0.002 to 0.01 mol.

The color photographic elements of the present invention can be conventional photographic elements containing a silver halide as a light-sensitive substance.

The silver halides used in the multilayer color photographic elements of this invention may be a fine dispersion (emulsion) of silver chloride, silver bromide, silver chlorobromide, silver iodo-bromide and silver chloro-iodobromide grains in a hydrophilic binder. Preferred silver halides are silver iodo-bromide or silver iodo-bromochloride containing 1 to 20% mole silver iodide. In silver iodo-bromide emulsions or silver iodo-bromo-chloride, the iodide can be uniformly distributed among the emulsion grains, or iodide level can varied among the grains. The silver halides can have a uniform grain size or a broad grain size distribution. The silver halide grains may be regular grains having a regular crystal structure such as cubic, octahedral, and tetradecahedral, or the spherical or irregular crystal structure, or those having crystal defects such as twin plane, or those having a tabular form, or the combination thereof.

The term "cubic grains" according to the present invention is intended to include substantially cubic grains, that is grains which are regular cubic grains bounded by crystallographic faces (100), or which may have rounded edges and/or vertices or small faces (111), or may even be nearly spherical when prepared in the presence of soluble iodides or strong ripening agents, such as ammonia. Particularly good results are obtained with silver halide grains having average grain sizes in the range from 0.2 to 3 μm, more preferably from 0.4 to 1.5 μm. Preparation of silver halide emulsions comprising cubic silver iodobroinide grains is described, for example, in Research Disclosure, Vol. 184, Item 18431, Vol. 176, Item 17644 and Vol. 308, Item 308119.

Other silver halide emulsions for use in this invention are those which employ one or more light-sensitive tabular grain emulsions. The tabular silver halide grains contained in the emiulsion of this invention have an average diameter:thickness ratio (often referred to in the art as aspect ratio) of at least 2:1, preferably 2:1 to 20:1, more preferably 3:1 to 14:1, and most preferably 3:1 to 8:1. Average diameters of the tabular silver halide grains suitable for use in this invention range from about 0.3 μm to about 5 μm, preferably 0.5 μm to 3 μm, more preferably 0.8 μm to 1.5 μm. The tabular silver halide grains suitable for use in this invention have a thickness of less than 0.4 μm, preferably less than 0.3 μm and more preferably less than 0.2 μm.

The tabular grain characteristics described above can be readily ascertained by procedures well known to those skilled in the art. The term "diameter" is defined as the diameter of a circle having an area equal to the projected area of the grain. The term "thickness" means the distance between two substantially parallel main planes constituting the tabular silver halide grains. From the measure of diameter and thickness of each grain the diameter:thickness ratio of each grain can be calculated, and the diaineter:thickness ratios of all tabular grains can be averaged to obtain their average diameter:thickness ratio. By this definition, the average diameter:thickness ratio is the average of individual tabular grain diameter:thickness ratios. In practice, it is simpler to obtain an average diameter and an average thickness of the tabular grains and to calculate the average diameter:thickness ratio as the ratio of these two averages. Whatever the used method may be, the average diaineter-:thickness ratios obtained do not greatly differ.

In the silver halide emulsion layer containing tabular silver halide grains, at least 15%, preferably at least 25%, and, more preferably, at least 50% of the silver halide grains are tabular grains having an average diameter:thickness ratio of not less than 2:1. Each of the above proportions, "15%", "25%" and "50%" means the proportion of the total projected area of the tabular grains having a diameter:thickness ratio of at least 2:1 and a thickness lower than 0.4 μm, as compared to the projected area of all of the silver halide grains in the layer.

It is known that photosensitive silver halide emulsions can be formed by precipitating silver halide grains in an aqueous dispersing medium comprising a binder, gelatin preferably being used as a binder.

The silver halide grains may be precipitated by a variety of conventional techniques. The silver halide emulsion can be prepared using a single-jet method, a double-jet method, or a combination of these methods or can be matured using, for instance, an ammonia method, a neutralization method, an acid method, or can be performed an accelerated or constant flow rate precipitation, interrupted precipitation, ultrafiltration during precipitation, etc. References can be found in Trivelli and Smith, The Photographic Journal, Vol. LXXIX, May 1939, pp. 330–338, T. H. James, The Theory of The Photographic Process, 4th Edition, Chapter 3, U.S. Pat. Nos. 2,222,264, 3,650,757, 3,917,485, 3,790,387, 3,716,276, 3,979,213, Research Disclosure, December 1989, Item 308119 "Photographic Silver Halide Emulsions, Preparations, Addenda, Processing and Systems", and Research Disclosure, September 1976, Item 14987.

One common technique is a batch process commonly referred to as the double-jet precipitation process by which a silver salt solution in water and a halide salt solution in water are concurrently added into a reaction vessel containing the dispersing medium.

In the double jet method, in which alkaline halide solution and silver nitrate solution are concurrently added in the gelatin solution, the shape and size of the formed silver halide grains can be controlled by the kind and concentration of the solvent existing in the gelatin solution and by the addition speed. Double-jet precipitation processes are described, for example, in GB 1,027,146, GB 1,302,405, U.S. Pat. No. 3,801,326, U.S. Pat. No. 4,046,376, U.S. Pat. No. 3,790,386, U.S. Pat. No. 3,897,935, U.S. Pat. No. 4,147,551, and U.S. Pat. No. 4,171,224.

The single jet method in which a silver nitrate solution is added in a halide and gelatin solution has been long used for mianufacturing photographic emulsion. In this method, because the varying concentration of halides in the solution determines which silver halide grains are formed, the formed silver halide grains are a mixture of different kinds of shapes and sizes.

Precipitation of silver halide grains usually occurs in two distinct stages. In a first stage, nucleation, formation of fine silver halide grain occurs. This is followed by a second stage, the growth stage, in which additional silver halide formed as a reaction product precipitates onto the initially formed silver halide grains, resulting in a growth of these silver halide grains. Batch double-jet precipitation processes are typically undertaken under conditions of rapid stirring of reactants in which the volume within the reaction vessel continuously increases during silver halide precipitation and soluble salts are formed in addition to the silver halide grains.

In order to avoid soluble salts in the emulsion layers of a photographic material from crystallizing out after coating and other photographic or mechanical disadvantages (stickiness, brittleness, etc.), the soluble salts formed during precipitation have to be removed.

In preparing the silver halide emulsions for use in the present invention, a wide variety of hydrophilic dispersing agents for the silver halides can be employed. As hydrophilic dispersing agent, any hydrophilic polymer conventionally used in photography can be advantageously employed including gelatin, a gelatin derivative such as acylated gelatin, graft gelatin, etc., albumin, gum arabic, agar agar, a cellulose derivative, such as hydroxyethylcellulose, carboxymethylcellulose, etc., a synthetic resin, such as polyvinyl alcohol, polyvinylpyrrolidone, polyacrylamide, etc. Other hydrophilic materials useful known in the art are described, for example, in Research Disclosure, Vol. 308, Item 308119, Section IX.

The silver halide grain emulsion for use in the present invention can be chemically sensitized using sensitizing agents known in the art. Sulfur containing compounds, gold and noble metal compounds, and polyoxylakylene compounds are particularly suitable. In particular, the silver halide emulsions may be chemically sensitized with a sulfur sensitizer, such as sodium thiosulfate, allylthiocyanate, allylthiourea, thiosulfinic acid and its sodium salt, sulfonic acid and its sodium salt, allylthiocarbamide, thiourea, cystine, etc.; an active or inert selenium sensitizer; a reducing sensitizer such as stannous salt, a polyamine, etc.; a noble metal sensitizer, such as gold sensitizer, more specifically potassium aurithiiocyanate, potassium chloroaurate, etc.; or a sensitizer of a water soluble salt such as for instance of ruthenium, sodium, iridium and the like, more specifically, aminonium chloropalladate, potassium chloroplatinate and sodium chloropalladite, etc.; each being employed either alone or in a suitable combination. Other useful examples of chemical sensitizers are described, for example, in Research Disclosure 17643, Section III, 1978 and in Research Disclosure 308119, Section III, 1989.

The silver halide emulsion for use in the present invention can be spectrally sensitized with dyes from a variety of classes, including the polymethyne dye class, which includes the cyanines, merocyanines, complex cyanines and merocyanines, oxonols, hemioxonols, styryls, merostyryls, and streptocyanine.

The cyanine spectral sensitizing dyes include, joined by a methine linkage, two basic heterocyclic nuclei, such as those derived from quinoline, pyrimidine, isoquinoline, indole, benzindole, oxazole, thiazole, selenazole, imidazole, benzoxazole, benzothiazole, benzoselenazole, benzoimidazole, naphthoxazole, naphtho-thiazole, naphthoselenazole, tellurazole, oxatellurazole.

The merocyanine spectral sensitizing dyes include, joined by a methine linkage, a basic heterocyclic nucleus of the cyanine-dye type and an acidic nucleus, which can be derived from barbituric acid, 2-thiobarbituric acid, rhodanine, hydantoin, 2-thiohydantoin, 2-pyrazolin-5-one, 2-isoxazolin-5-one, indan-1,3-dione, cyclohexane-1,3-dione, 1,3-dioxane-4,6-dione, pyrazolin-3,5-dione, pentane-2,4-dione, alkylsulfonylacetonitrile, malononitrile, isoquinolin-4-one, chromane-2,4-dione, and the like.

One or more spectral sensitizing dyes may be used. Dyes with sensitizing maxima at wavelengths throughout the visible and infrared spectrum and with a great variety of spectral sensitivity curve shapes are known. The choice and relative proportion of dyes depends on the region of the spectrum to which sensitivity is desired and on the shape of the spectral sensitivity desired.

Examples of sensitizing dyes can be found in Venkatarainan, *The chemistry of Syntlielic Dyes*, Academic Press, New York, 1971, Chapter V, James, *The Theory of the Photographic Process*, 4th Ed., Macmillan, 1977, Chapter 8, F. M. Hamer, *Cyanine Dyes and Related Compounds*, John Wiley and Sons, 1964, and in Research Disclosure 308119, Section III, 1989.

The silver halide emulsions for use in this invention can contain optical brighteners, antifogging agents and stabilizers, filtering and antihalo dyes, hardeners, coating aids, plasticizers and lubricants and other auxiliary substances, as for instance described in Research Disclosure 17643, Sections V, VI, VIII, X, XI and XII, 1978, and in Research Disclosure 308119, Sections V, VI, VIII, X, XI, and XII, 1989.

The silver halide emulsion for use in the present invention can be used for the manufacture of multilayer light-sensitive silver halide color photographic elements, such as color negative photographic elements, color reversal photographic elements, color positive photographic elements, false color address photographic elements (such as those disclosed in U.S. Pat. No. 4,619,892) and the like, the preferred ones being color negative photographic elements.

Silver halide inultilayer color photographic elements usually comprise, coated on a support, a red sensitized silver halide emulsion layer associated with cyan dye-forming color couplers, a green sensitized silver halide emulsion layer associated with magenta dye-forming color couplers and a blue sensitized silver halide emulsion layer associated with yellow dye-forming color couplers. Each layer is usually comprised of multiple (two or more) emulsion sub-layers sensitive to a given region of visible spectrum. When multilayer materials contain multiple blue, green or red sub-layers, these can be in any case relatively faster and relatively slower sub-layers. These elements additionally comprise other non-light sensitive layers, such as intermediate layers, filter layers, antihalation layers and protective layers, thus forming a multilayer structure. These color photographic elements, after imagewise exposure to actinic radiation, are processed in a chromogenic developer to yield a visible color image. The layer units can be coated in any conventional order, but in a preferred layer arrangement the red-sensitive layers are coated nearest the support and are overcoated by the green-sensitive layers, a yellow filter layer and the blue-sensitive layers.

Suitable color couplers are preferably selected from the couplers having diffusion preventing groups, such as groups having a hydrophobic organic residue of about 8 to 32 carbon atoms, introduced into the coupler molecule in a non-splitting-off position. Such a residue is called a "ballast group". The ballast group is bonded to the coupler nucleus directly or through an imino, ether, carbonamido, sulfonamido, ureido, ester, imido, carbamoyl, sulfamoyl bond, etc. Examples of suitable ballasting groups are described in U.S. Pat. No. 3,892,572.

Said non-diffusible couplers are introduced into the light-sensitive silver halide emulsion layers or into non-light-sensitive layers adjacent thereto. On exposure and color development, said couplers give a color which is complementary to the light color to which the silver halide emulsion layers are sensitive. Consequently, at least one non-diffusible cyan-image forming color coupler, generally a phenol or an α-naphthol compound, is associated with red-sensitive silver halide emulsion layers, at least one non-diffusible magenta image-forming color coupler, generally a 5-pyrazolone or a pyrazolotriazole compound, is associated with green-sensitive silver halide emulsion layers and at least one non-diffusible yellow image forming color coupler, generally an acylacetanilide compound, is associated with blue-sensitive silver halide emulsion layers.

Said color couplers may be 4-equivalent and/or 2-equivalent couplers, the latter requiring a smaller amount of silver halide for color production. As it is well known, 2-equivalent couplers derive from 4-equivalent couplers since, in the coupling position, they contain a substituent which is released during coupling reaction. 2-equivalent couplers which may be used in silver halide color photographic elements include both those substantially colorless and those which are colored ("masking couplers"). The 2-equivalent couplers also include white couplers which do not form any dye on reaction with the color developer oxidation products. The 2-equivalent color couplers include also DIR couplers which are capable of releasing a diffusing development inhibiting compound on reaction with the color developer oxidation products.

The most useful cyan-forming couplers are conventional phenol compounds and α-naphthol compounds. Examples of cyan couplers can be selected from those described in U.S. Pat. Nos. 2,369,929; 2,474,293; 3,591,383; 2,895,826; 3,458,315; 3,311,476; 3,419,390; 3,476,563 and 3,253,924; in British patent 1,201,110, and in ResearGh Disclosure 308119, Section VII, 1989.

The most useful magenta-forming couplers are conventional pyrazolone type compounds, indazolone type compounds, cyanoacetyl compounds, pyrazolotriazole type compounds, etc, and particularly preferred couplers are pyrazolone type compounds. Magenta-forming couplers are described for example in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, in DE patent 1,810,464, in DE patent applications 2,408,665, 2,417,945, 2,418,959 and 2,424,467; in JP patent applications 20,826/76, 58,922/77, 129,538/74, 74,027/74, 159,336/75, 42,121/77, 74,028/74, 60,233/75, 26,541/76 and 55,122/78, and in Research Disclosure 308119, Section VII, 1989.

The most useful yellow-forming couplers are conventional open-chain ketomethylene type couplers. Particular examples of such couplers are benzoylacetanilide type and pivaloyl acetanilide type compounds. Yellow-forming couplers that can be used are specifically described in U.S. Pat. Nos. 2,875,057, 3,235,924, 3,265,506, 3,278,658, 3,369,859, 3,408,194, 3,415,652 3,528,322, 3,551,151, 3,682,322, 3,725,072 and 3,891,445, in DE patents 2,219,917, 2,261,361 and 2,414,006, in GB patent 1,425,020, in JP patent 10,783/76 and in JP patent applications 26,133/72, 73,147/73, 102,636/76, 6,341/75, 123,342/75, 130,442/75, 1,827/76, 87,650/75, 82,424/77 and 115,219/77, and in Research Disclosure 308119, Section VII, 1989.

Colored couplers can be used which include those described for example in U.S. Pat. Nos. 3,476,560, 2,521,908 and 3,034,892, in JP patent publications 2,016/69, 22,335/63, 11,304/67 and 32,461/69, in JP patent applications 26,034/76 and 42,121/77 and in DE patent application 2,418,959. The light-sensitive silver halide color photographic element may contain high molecular weight color couplers as described for example in U.S. Pat. No. 4,080,211, in EP Pat. Appi. No. 27,284 and in DE Pat. Appl. Nos. 1,297,417, 2,407,569, 3,148,125, 3,217,200, 3,320,079, 3,324,932, 3,331,743, and 3,340,376, and in Research Disclosure 308119, Section VII, 1989.

Colored cyan couplers can be selected from those described in U.S. Pat. Nos. 3,934,802; 3,386,301 and 2,434,272, colored magenta couplers can be selected from the colored magenta couplers described in U.S. Pat. Nos. 2,434,272; 3,476,564 and 3,476,560 and in British patent 1,464,361. Colorless couplers can be selected from those described in British patents 861,138, 914,145 and 1,109,963 and in U.S. Pat. No. 3,580,722 and in Research Disclosure 308119, Section VII, 1989.

Also, couplers providing diffusible colored dyes can be used together with the above mentioned couplers for improving graininess and specific examples of these couplers are magenta couplers described in U.S. Pat. No. 4,366,237 and GB Pat. No. 2,125,570 and yellow, magenta and cyan couplers described in EP Pat. No. 96,873, in DE Pat. Appl. No. 3,324,533 and in Research Disclosure 308119, Section VII, 1989.

Also, among the 2-equivalent couplers are those couplers which carry in the coupling position a group which is released in the color development reaction to give a certain photographic activity, e.g. as development inhibitor or accelerator or bleaching accelerator, either directly or after removal of one or further groups from the group originally released. Examples of such 2-equivalent couplers include the known DIR couplers as well as DAR, FAR and BAR couplers. Typical examples of said couplers are described in DE Pat. Appl. Nos. 2,703,145, 2,855,697, 3,105,026, 3,319,428, 1,800,420, 2,015,867, 2,414,006, 2,842,063, 3,427,235, 3,209,110, and 1,547,640, in GB Pat. Nos. 953,454 and 1,591,641, in EP Pat. Appl. Nos. 89,843, 117,511, 118,087, 193,389, and 301,477 and in Research Disclosure 308119, Section VII, 1989.

Examples of non-color forming DIR coupling compounds which can be used in silver halide color elements include those described in U.S. Pat. Nos. 3,938,996; 3,632,345; 3,639,417; 3,297,445 and 3,928,041; in German patent applications S.N. 2,405,442; 2,523,705; 2,460,202; 2,529,350 and 2,448,063; in Japanese patent applications S.N. 143,538/75 and 147,716/75, in British patents 1,423,588 and 1,542,705 and 301,477 and in Research Disclosure 308119, Section VII, 1989.

In order to introduce the couplers into the silver halide emulsion layer, some conventional methods known to the skilled in the art can be employed. According to U.S. Pat. Nos. 2,322,027, 2,801,170, 2,801,171 and 2,991,177, the couplers can be incorporated into the silver halide emulsion layer by the dispersion technique, which consists of dissolving the coupler in a water-immiscible high-boiling organic solvent and then dispersing such a solution in a hydrophilic colloidal binder-under the form of very small droplets. The preferred colloidal binder is gelatin, even if some other kinds of binders can be used.

Another type of introduction of the couplers into the silver halide emulsion layer consists of the so-called "loaded-latex technique". A detailed description of such technique can be found in BE patents 853,512 and 869,816, in U.S. Pat. Nos. 4,214,047 and 4,199,363 and in EP patent 14,921. It consists of mixing a solution of the couplers in a water-miscible organic solvent with a polymeric latex consisting of water as a continuous phase and of polymeric particles having a mean diameter ranging from 0.02 to 0.2 micrometers as a dispersed phase.

Another useful method is further the Fischer process. According to such a process, couplers having a water-soluble group, such as a carboxyl group, a hydroxy group, a sulfonic group or a sulfonainido group, can be added to the photographic layer for example by dissolving them in an alkaline water solution.

Useful methods of introduction of couplers into-silver halide emulsions are described in Research Disclosure 308119, Section VII, 1989.

The layers of the photographic elements can be coated on a variety of supports, such as cellulose esters supports (e.g., cellulose triacetate supports), paper supports, polyesters film supports (e.g., polyethylene terephthalate film supports or polyethylene naphthalate film supports), and the like, as described in Research Disclosure 308119, Section XVII, 1989.

The photographic elements according to this invention, may be processed after exposure to form a visible image upon association of the silver halides with an alkaline aqueous medium in the presence of a developing agent contained in the medium or in the material, as known in the art. The aromatic primary amine color developing agent used in the photographic color developing composition can be any of known compounds of the class of p-phenylendiainine derivatives, widely employed in various color photographic process. Particularly useful color developing agents are the p-phenylendiainine derivatives, especially the N,N-dialkyl-p-phenylene diamine derivatives wherein the alkyl groups or the aromatic nucleus can be substituted or not substituted.

Examples of p-phenylene diamine developers include the salts of: N,N-diethyl-p-phenylendiamine, 2-ainino-5-diethylainino-toluene, 4-amino-N-ethyl-N-(α-methanesulphonainidoethyl)-m-toluidine, 4-amino-3-methyl-N-ethyl-N-(α-hydroxy-ethyl)-aniline, 4-aminio-3-(α-methylsulfonamidoethyl)-N,N-diethylaniline, 4-amino-N,N-diethyl-3-(N'-methyl-α-methylsulfonamido)-aniline, N-ethyl-N-methoxy-ethyl-3-methyl-p-phenylenediainine and the like, as described, for instance, in U.S. Pat. Nos. 2,552,241; 2,556,271; 3,656,950 and 3,658,525.

Examples of commonly used developing agents of the p-phenylene diamine salt type are: 2-amino-5-diethylaminotoluene hydrochloride (generally known as CD2 and used in the developing solutions for color positive photographic material), 4-ainino-N-ethyl-N-(α-methanesulfonamidoethyl)-in-toluidine sesquisulfate monohydrate (generally known as CD3 and used in the developing solution for photographic papers and color reversal materials) and 4-amino-3-iiiethyl-N-ethyl-N-(β-hydroxyethyl)-aniline sulfate (generally known as CD4 and used in the developing solutions for color negative photographic materials).

Said color developing agents are generally used in a quantity from about 0.001 to about 0.1 moles per liter, preferably from about 0.0045 to about 0.04 moles per liter of photographic color developing compositions.

In the case of color photographic materials, the processing comprises at least a color developing bath and, optionally, a prehardening bath, a neutralizing bath, a first (black and white) developing bath, etc. These baths are well known in the art and are described for instance in Research Disclosure 17643, 1978, and in Research Disclosure 308119, Sections XIX and XX, 1989.

After color development, the image-wise developed metallic silver and the remaining silver salts generally must be removed from the photographic element. This is performed in separate bleaching and fixing baths or in a single bath, called blix, which bleaches and fixes the image in a single step. The bleaching bath is a water solution having a pH equal to 5.60 and containing an oxidizing agent, normally a complex salt of an alkali metal or of ammonium and of trivalent iron with an organic acid, e.g., EDTA.Fe.$NH_4$, wherein EDTA is the ethylenedianiino-tetracetic acid, or PDTA.Fe.$NH_4$, wherein PDTA is the propylenediaminotetraacetic acid. While processing, this bath is continuously aired to oxidize the divalent iron which forms while bleaching the silver image and regenerated, as known in the art, to maintain the bleach effectiveness. The bad working of these operations may cause the drawback of the loss of cyan density of the dyes.

Further to the above mentioned oxidizing agents, the blix bath can contain known fixing agents, such as for example ammonium or alkali metal thiosulfates. Both bleaching and fixing baths can contain other additives, e.g., polyalkyleneoxide compounds, as described for example in GB patent 933,008 in order to increase the effectiveness of the bath, or thioether compounds known as bleach accelerators.

The present invention will be illustrated with reference to the following examples, but it should be understood that these examples do not limit the present invention.

EXAMPLE 1

A multilayer silver halide color photographic film A1 was prepared by coating a cellulose triacetate support base, subbed with gelatin, with the following layers in the following order:

(1) a layer of black colloidal silver dispersed in gelatin having a silver coverage of 0.170 g/$m^2$ and a gelatin coverage of 1.260 g/$in^2$;

(2) a layer of low sensitivity red-sensitive silver halide emulsion comprising a sulfur and gold sensitized low-sensitivity silver bromoiodide emulsion (having 2.5% silver iodide moles and a mean grain size of 0.18 μm), optimally spectrally sensitized with sensitizing dyes S-1, S-2 and S-3, at a total silver coverage of 0.70 g/$m^2$ and a gelatin coverage of 1.320 g/$m^2$, containing the cyan dye-forming coupler C-1 at a coverage of 0.340 g/$m^2$, the cyan dye-forming DIR coupler C-2 at a coverage of 0.020 g/$m^2$ and the magenta colored cyan-dye forming masking coupler C3 at a coverage of 0.022 g/$m^2$, dispersed in a mixture of triphenylphosphate and dibutylphthalate;

(3) a layer of medium-sensitivity red-sensitive silver halide emulsion comprising a sulfur and gold sensitized silver broiiioiodide emulsion (having 6% silver iodide moles and a mean grain size of 0.50 μm), optimally spectrally sensitized with sensitizing dyes S-1, S-2 and S-3, at a silver coverage of 0.820 g/$m^2$ and a gelatin coverage of 0.790 g/$m^2$, containing the cyan dye-forming coupler C-1 at a coverage of 0.281 g/$m^2$, the cyan dye-forming DIR coupler C-2 at a coverage of 0.019 g/$m^2$, and the magenta colored cyan dye-forming masking coupler C-3 at a coverage of 0.049 g/$m^2$, dispersed in a mixture of triphenylphosphate and dibutylphthalate;

(4) a layer of high-sensitivity red-sensitive silver halide emulsion comprising a sulfur and gold sensitized silver broinoiodide emulsion (having 12% silver iodide moles and a mean grain size of 1.4 μm), optimally spectrally sensitized with sensitizing dyes S-1, S-2 and S-3, at a silver coverage of 1.550 g/$m^2$, and a gelatin coverage of 1.270 g/$m^2$, containing the cyan dye-forming coupler C-1 at a coverage of 0.134 g/$m^2$, the cyan dye-forming DIR coupler C-2 at a coverage of 0.030 g/$m^2$, the magenta colored cyan dye-forming masking coupler C-3 at a coverage of 0.013 g/$m^2$ and the cyan dye-forming coupler C-4 at a coverage of 0.051 g/$m^2$, dispersed in a mixture of tricresylphosphate and butylacetanilide;

(5) an intermediate layer containing 1.10 g/$m^2$ of gelatin and 0.071 g/$m^2$ of the hardener H-1;

(6) a layer of low sensitivity green sensitive silver halide emulsion comprising a sulfur and gold sensitized silver bromoiodide emulsion (having 2.5% silver iodide moles and a mean grain size of 0.18 μm), at a silver coverage of 0.540 g/$m^2$, optimally spectrally sensitized with sensitizing dyes S-4 and S-5, at a gelatin coverage of 1.330 g/$m^2$, containing the magenta dye-forming coupler M-1 at a coverage of 0.290 g/$m^2$, the magenta dye-forming DIR coupler M-2 at a coverage of 0.009 g/$m^2$, and the yellow colored magenta dye-forming couplers M-3 and M-4 at a coverage of 0.299 g/m$^2$, dispersed in tricresylphosphate;

(7) a layer of medium-sensitivity green sensitive silver halide emulsion comprising a sulfur and gold sensitized silver bromoiodide emulsion (having 6% silver iodide moles and a mean grain size of 0.5 $\mu$m), optimally spectrally sensitized with sensitizing dyes S-4 and S-5, at a silver coverage of 0.850 g/m$^2$ and a gelatin coverage of 1.150 g/m$^2$, containing the magenta dye-forming coupler M-1 at a coverage of 0.231 g/m$^2$, the magenta dye-forming DIR coupler M-2 at a coverage of 0.024 g/m$^2$, and the yellow colored magenta dye forming couplers M-3 and M-4 at a coverage of 0.102 g/m$^2$, dispersed in tricresylphosphate;

(8) a layer of high-sensitivity red-sensitive silver halide emulsion comprising a sulfur and gold sensitized silver bromoiodide emulsion (having 12% silver iodide moles and a mean grain size of 1.4 $\mu$m), optimally spectrally sensitized with sensitizing dyes S-4 and S-5, at a silver coverage of 1.490 g/m$^2$ and a gelatin coverage of 1.220 g/m$^2$, containing the magenta dye-forming coupler M-5 at a coverage of 0.296 g/m$^2$, and the yellow colored magenta dye forming couplers M-3 and M-4 at a coverage of 0.049 g/m$^2$, dispersed in tricresylphosphate;

(9) an intermediate layer containing 1.070 g/m$^2$ of gelatin

(10) a yellow filter layer containing 1.070 g/m$^2$ of gelatin, 0.039 g/m$^2$ of silver and 0.065 g/m$^2$ of the hardener H-1;

(11) a layer of low-sensitivity blue-sensitive silver halide emulsion comprising a blend of 55% by weight of the low-sensitivity emulsion of layer (2) and of 45% by weight of the medium-sensitivity emulsion of layer (3) at a silver coverage of 0.580 g/m$^2$, optimially spectrally sensitized with sensitizing dye S-6, at a gelatin coverage of 1.260 g/m$^2$, containing the yellow dye forming coupler Y-1 at a coverage of 1.008 g/m$^2$ and the yellow dye forming DIR coupler Y-2 at a coverage of 0.053 g/m$^2$, dispersed in a mixture of diethyl-lauramide and dibutylphthalate;

(12) a layer of high-sensitivity blue sensitive silver halide emulsion comprising a sulfur and gold sensitized silver bromoiodide emulsion (having 12% silver iodide moles and a mean grain size of 1.25 $\mu$m), optimally spectrally sensitized with sensitizing dye S-6, at a silver coverage of 0.840 g/m$^2$ and a gelatin coverage of 1.10 g/m$^2$, containing the yellow dye-forming coupler Y-1 at a coverage of 0.282 g/m$^2$ and the yellow dye forming DIR coupler Y-2 at a coverage of 0.031 g/m$^2$, dispersed in a mixture of diethyllauramide and dibutylphthalate;

(13) a protective layer of 1.230 g/m$^2$ of gelatin, comprising the UV absorber UV-1 at a coverage of 0.131 g/m$^2$, the UV absorber UV-2 at a coverage of 0.131 g/m$^2$, a fine grain silver bromide emulsion at a silver coverage of 0.220 g/m$^2$; and

(14) a top coat layer of 0.86 g/m$^2$ of gelatin containing 0.190 g/m$^2$ of poly-methylmethacrylate matting agent MA-1 in form of beads having an average diameter of 2.5 micrometers, and the hardener H-2 at a coverage of 0.408 g/m$^2$.

Film B1 was prepared in a similar manner, but additionally including in the 12th high-sensitivity blue-sensitive layer of film A1 0.027 g/m$^2$ of the cyan dye-forming coupler I1 according to the present invention.

Samples of Films A1 and B1 were exposed to a light source having a color temperature of 5,500K (white light exposure). The exposed samples were then color processed using the KODAK FLEXICOLOR (C41) process as described in *British Journal of Photography Annual,* 1988, pp. 196–198, in the following sequence:

1. Color development
2. Bleach
3. Wash
4. Fix
5. Wash

For each processed sample, the characteristic curves for the red, green and blue light absorptions were obtained conventionally. Values of fog (Dinin), maximnum density (Dmax), sensitivity in Log E at density of 0.2 above Dinin (Speed1) and 1.0 above Dinin (Speed2), and toe contrast (Gamma) of each Film are reported in Table 1.

TABLE 1

| Film | Layer | Dmin | Dmax | Speed1 | Speed2 | Gamma |
|---|---|---|---|---|---|---|
| A1 | Cyan | 0.32 | 2.27 | 2.16 | 0.76 | 0.54 |
| B1 | Cyan | 0.35 | 2.29 | 2.24 | 0.81 | 0.53 |
| A1 | Magenta | 0.73 | 2.80 | 2.32 | 1.08 | 0.64 |
| B1 | Magenta | 0.76 | 2.75 | 2.31 | 1.07 | 0.61 |
| A1 | Yellow | 0.93 | 2.93 | 2.45 | 1.09 | 0.56 |
| B1 | Yellow | 0.92 | 2.93 | 2.43 | 1.09 | 0.58 |

The data reported above show that film B1 (containing in the high-sensitivity blue-sensitive layer a cyan dye-forming coupler according to the present invention) has a remarkable increase in sensitivity of the cyan layer (the combined three red-sensitive layers).

Samples of films A1 and B1 were used for photographing a Macbeth color chart. After photographing the samples were developed in the same manner as above and printed on Kodak Color Paper so as to reproduce gray color having been photographed at the same time. With such prints, spectral reflectivity of each color was measured using a Gretag spectrophotometer type SPM 100 and chromaticity points of respective colors were plotted on a 1976 CIE a*b* chromaticity diagram to obtain FIG. 1. From the data, it results that the addition of a cyan dye-forming coupler to the high-sensitivity blue-sensitive layer of a multilayer color photographic element does not change the reproducibility of colors.

Samples of films A1 and B1 were sensitoinetrically exposed to different lights: 2,850K, 3,200K (using a Shott 5,500K filter and a Kodak Wratten™ W85 filter), 4,400K (using a Shott 5,500K filter and a Kodak Wratten™ W81D filter), 6,200K (using a Sholt 5,500K filter and a Kodak Wratten™ W82A filter), 7,200K (using a Shott 5,500K filter and a Kodak Wratten™ W82C filter), 9,100K (using a Shott 5,500K filter, a Kodak Wratten™ W82C filter and a Kodak Wratten™ W82B filter), 10,000K (using a Shott 5,500K filter and two Kodak Wratten™ W82C filters), 15,000K (using a Shott 5,500K filter and a Kodak Wratten™ W80A filter), and 5,500K (using a Shott 5,500K filter). The exposed films were then processed as described above. For each exposed sample the magenta less cyan and the yellow less cyan color balance was measured at different optical densities: 0.20 above cyan Dmin (CB1), +0.50 log E (CB2), +1.00 log E (CB3), +1,50 log E (CB4) and +2.0 log E (CB5). In the following Table 2, the difference in color balance between exposure at 3,200K and exposure at 15,000K is reported for each film.

TABLE 2

| | Magenta - Cyan | | | | | Yellow - Cyan | | | | |
|---|---|---|---|---|---|---|---|---|---|---|
| Film | CB1 | CB2 | CB3 | CB4 | CB5 | CB1 | CB2 | CB3 | CB4 | CB5 |
| A1 | 0.38 | 0.47 | 0.43 | 0.39 | 0.41 | 0.73 | 0.89 | 0.99 | 1.09 | 0.97 |
| B1 | 0.30 | 0.42 | 0.41 | 0.39 | 0.41 | 0.56 | 0.78 | 0.89 | 0.99 | 0.97 |

The data show less variability in color balance, especially in the low density portion of the characteristic curve, with the film containing a cyan dye-forming coupler in the uppermost highest sensitivity blue-sensitive layer according to this invention.

Formulas of compounds used in this example will be presented below.

Cyan dye forming coupler C-1:

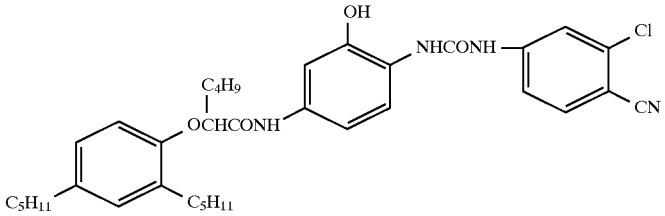

Cyan dye forming DIR coupler C-2:

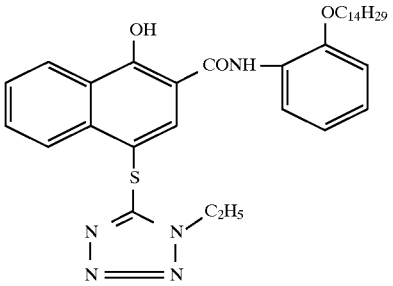

Magenta colored cyan dye forming coupler C-3:

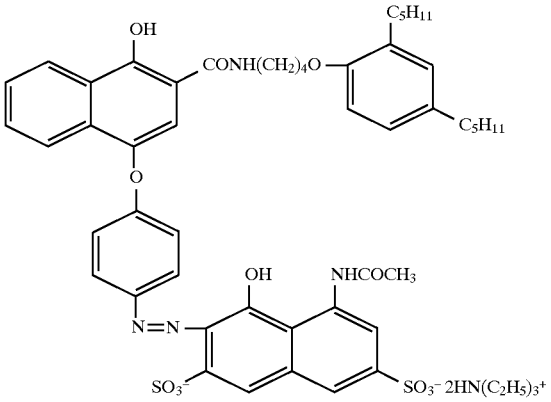

Cyan dye forming coupler C-4 (corresponding to I-1):

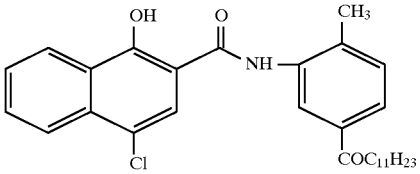

-continued
Magenta dye forming coupler M-1:
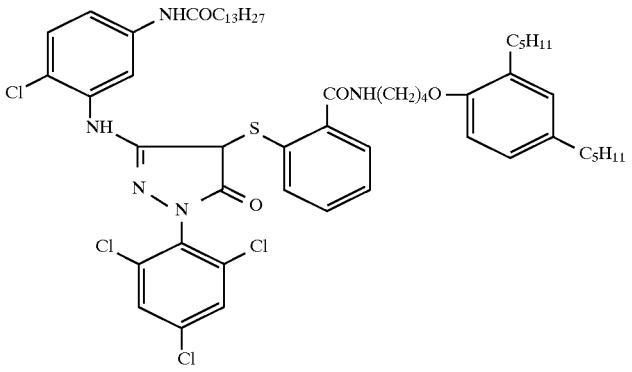
Magenta dye forming DIR coupler M-2:
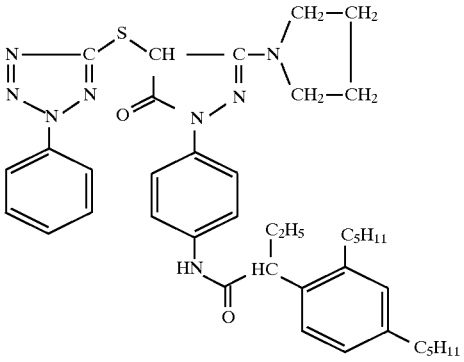
Yellow colored magenta dye forming coupler M-3:
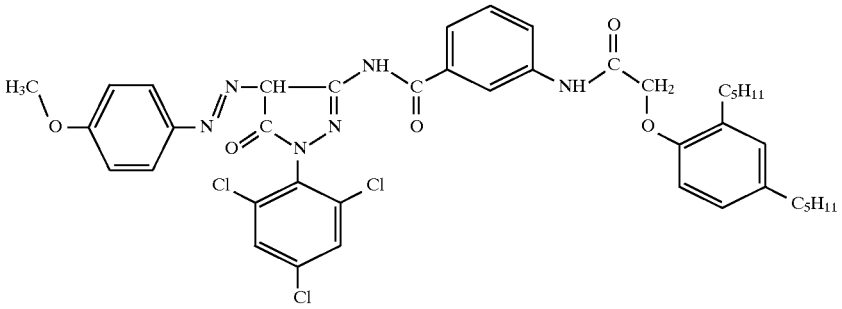
Yellow colored magneta dye forming coupler M-4:
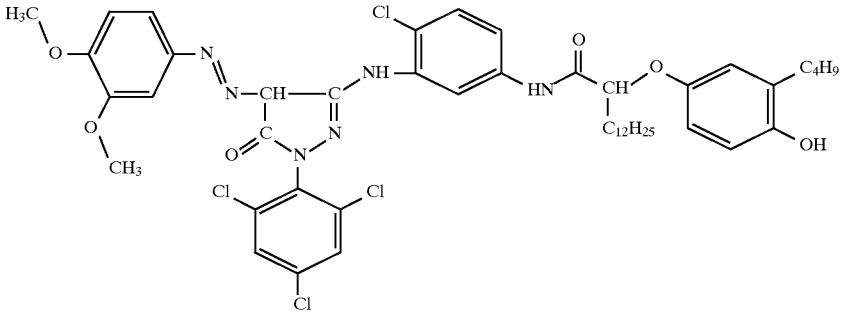

-continued
Magenta dye forming coupler M-5:
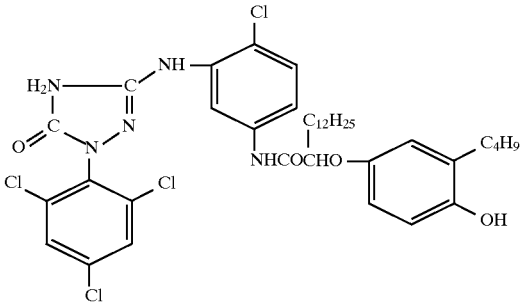
Yeloow dye forming coupler Y-1:
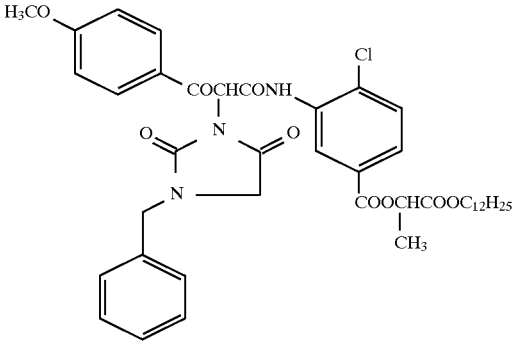
Yellow dye forming DIR coupler Y-2:
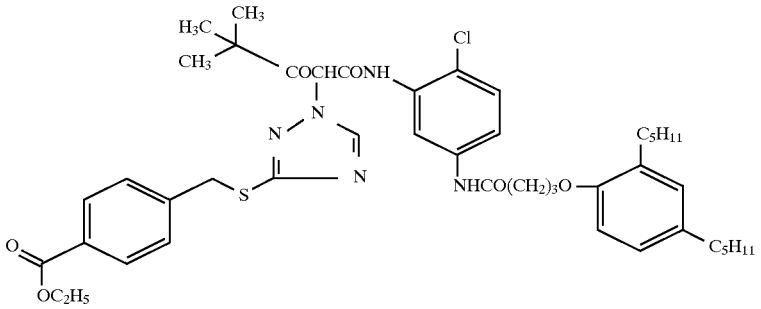
Red Snesitizer S-1
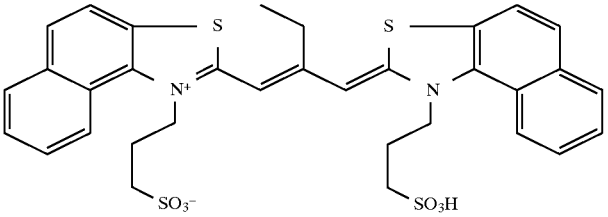
Red Snesitizer S-2
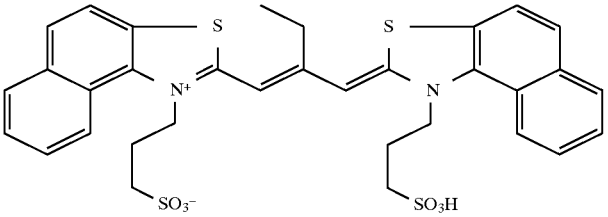

-continued
Red Snesitizer S-3
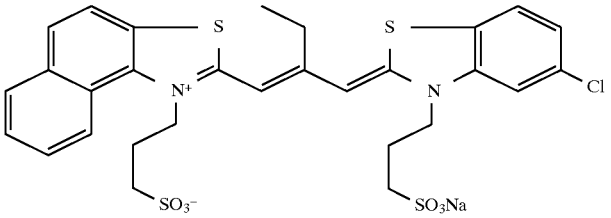
Green Sensitizer S-4
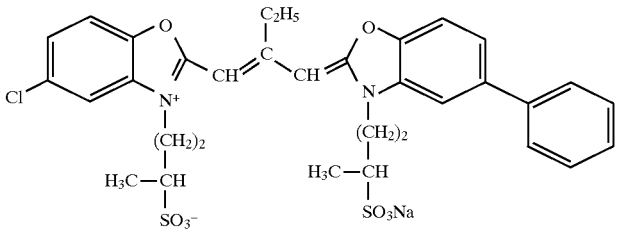
Green Sensitizer S-5
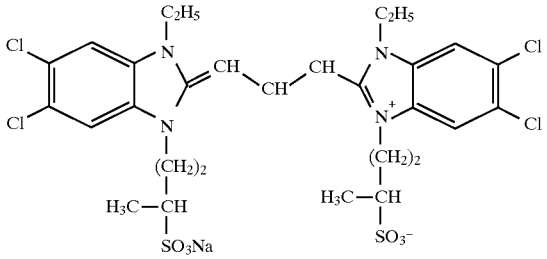
Blue Sensitizer S-6
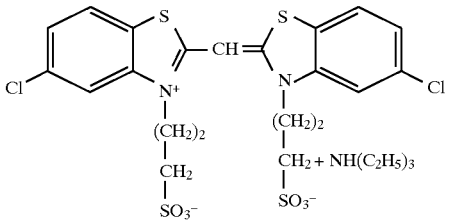
UV absorber UV-1:
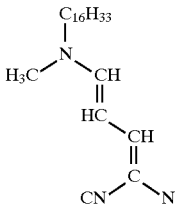
UV absorber UV-2:
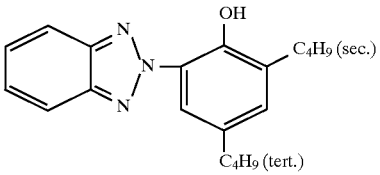
Matting agent MA-1:
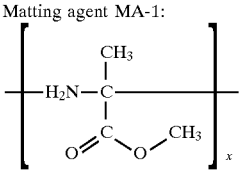

-continued

Hardener H-1:

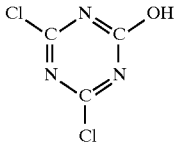

Hardener H-2:

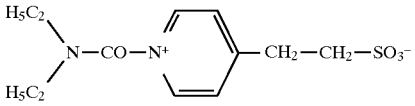

EXAMPLE 2

Film A2 was prepared similar to film B1 of Example 1, but employing in the 12th high-sensitivity blue-sensitive layer, instead of the cyan dye-forming coupler C-4 according to the present invention, 0.034 g/m$^2$ of the cyan dye-forming coupler C-1.

Film B2 was prepared similar to film B1 of Example 1.

Samples of filims A2 and B2 were exposed and processed as described in Example 1. For each exposed and color processed sample, the characteristic curves for the red, green and blue light absorptions were obtained conventionally. Values of fog (Dmin), maximum density (Dmax), sensitivity in Log E at density of 0.2 above Dmin (Speed1) and 1.0 above Dmin (Speed2), and toe contrast (Gamma) of each Film are reported in Table 3.

TABLE 3

| Film | Layer | Dmin | Dmax | Speed1 | Speed2 | Gamma |
|---|---|---|---|---|---|---|
| B2 | Cyan | 0.26 | 2.01 | 2.33 | 0.77 | 0.49 |
| A2 | Cyan | 0.27 | 1.97 | 2.15 | 0.66 | 0.50 |
| B2 | Magenta | 0.63 | 2.48 | 2.32 | 0.85 | 0.51 |
| A2 | Magenta | 0.63 | 2.51 | 2.29 | 0.86 | 0.53 |
| B2 | Yellow | 0.88 | 3.09 | 2.50 | 1.11 | 0.54 |
| A2 | Yellow | 0.89 | 3.14 | 2.50 | 1.10 | 0.53 |

The data reported above show that film B2 (containing in the high-sensitivity blue-sensitive layer a cyan dye-forming coupler according to the present invention) has a remarkable increase in sensitivity of the cyan layer (the combined three red-sensitive layers) when conipared with film A2 (containing in the high-sensitivity blue-sensitive layer a cyan dye-forming coupler not within the present invention).

EXAMPLE 3

Film A3 was prepared similar to film B1 of Example 1, but containing in the 12th high-sensitivity blue-sensitive layer the yellow dye-forining coupler Y-1 at a coverage of 0.260 g/m$^2$, the yellow dye forming DIR coupler Y-2 at a coverage of 0.029 g/m$^2$, dispersed in a mixture of diethyllauramide and dibutylphthalate.

Film B3 was prepared in a similar manner, but employing in the 4th high-sensitivity red sensitive layer and in the 12th high-sensitivity blue-sensitive layer, instead of the cyan dye-forming coupler C-4 (corresponding to coupler I1), 0.051 and, respectively, 0.025 g/m$^2$ the cyan dye-forming coupler I1 according to the present invention.

Film C3 was prepared a similar manner, but employing in the 4th high-sensitivity red-sensitive silver halide emulsion layer and in the 12th high-sensitivity blue-sensitive layer, instead of the cyan dye-forming coupler C-4 (corresponding to coupler I1 according to the present invention), 0.051 and, respectively, 0.025 g/m$^2$ the cyan dye-forming coupler C-5.

Samples of films A3, B3 and C3 were exposed and processed as described in Example 1. For each exposed and color processed sample, the characteristic curves for the red, green and blue light absorptions were obtained conventionally. Values of fog (Dmin), maximum density (Dmax), sensitivity in Log E at density of 0.2 above Dmin (Speed1) and 1.0 above Dmin (Speed2), and toe contrast (Gamma) of each Film are reported in Table 4.

TABLE 4

| Film | Layer | Dmin | Dmax | Speed1 | Speed2 | Gamma |
|---|---|---|---|---|---|---|
| A3 | Cyan | 0.21 | 1.96 | 2.31 | 0.63 | 0.44 |
| B3 | Cyan | 0.23 | 1.97 | 2.30 | 0.60 | 0.43 |
| C3 | Cyan | 0.18 | 1.90 | 2.21 | 0.57 | 0.45 |
| A3 | Magenta | 0.61 | 2.60 | 2.32 | 1.06 | 0.56 |
| B3 | Magenta | 0.60 | 2.65 | 2.33 | 1.08 | 0.57 |
| C3 | Magenta | 0.60 | 2.62 | 2.31 | 1.07 | 0.59 |
| A3 | Yellow | 0.84 | 3.05 | 2.51 | 1.19 | 0.58 |
| B3 | Yellow | 0.85 | 3.03 | 2.50 | 1.19 | 0.58 |
| C3 | Yellow | 0.85 | 3.04 | 2.52 | 1.20 | 0.57 |

The data reported above show that filins A3 and B3 (containing in the high-sensitivity blue-sensitive layer cyan dye-forming couplers according to the present invention) have a remarkable increase in sensitivity of the cyan layer (the combined three red-sensitive layers) when compared with film C3 (containing in the high-sensitivity blue-sensitive layer a cyan dye-forming coupler not within the present invention).

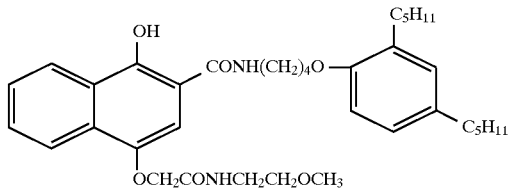

We claim:

1. A multilayer color photographic element comprising a support having coated thereon red-, green- and blue-sensitive silver halide emulsion layers comprising, respectively, cyan, magneta and yellow dye-forming couplers, wherein the blue-sensitive emulsion layer comprises at least two blue-sensitive emulsions layers, the uppermost of which, located furthest from the support, has the highest sensitivity and the lowermost of which, located closest to the support, has the lowest sensitivity, characterized in that the uppermost highest sensitivity blue-sensitive silver halide emulsion layer comprises a yellow dye-forming coupler and a cyan dye-forming coupler, the cyan dye-forming coupler being represented by the formula

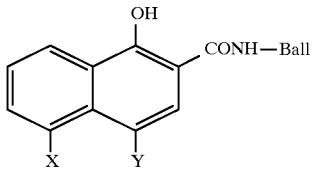

wherein Ball is a ballasting group which renders the coupler non-diffusible in photographic coatings, Y represents a halogen atom, and X represents a hydrogen atom.

2. A photographic element as claimed in claim 1, wherein Ball comprises a hydrophobic group of at least 8 carbon atoms.

3. A photographic element as claimed in claim 1, wherein the monovalent organic group is represented by the formula $R_2(W)_n$— wherein W represents an imino group, a carbonyl group or a sulfonyl group, n represents 0 or 1, and $R_2$ represents a hydrogen atom, an aliphatic group, an aromatic group, a heterocyclic group, a hydroxyl group, —$OR_3$, —$COR_3$, —$SO_2R_3$ or

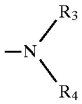

wherein $R_3$ and $R_4$ (which may be the same or different) each is an aliphatic group, an aromatic group, or a heterocyclic group, or $R_3$ and $R_4$ can together form a nitrogen-containing heterocyclic ring.

4. A photographic element as claimed in claim 1, wherein the yellow dye-forming coupler is represented by the formula

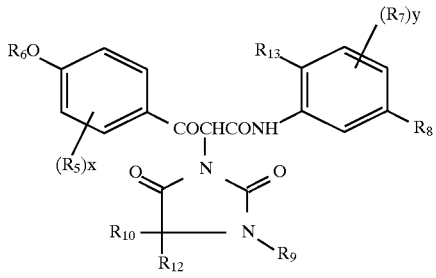

wherein $R_5$ and $R_7$, equal or different, each represents an alkyl group, aryl group, halogen atom or alkoxy group; x and y are individually 0, 1 or 2; $R_6$ is an alkyl group; $R_8$ represents a ballasting group which renders the coupler non-diffusible in photographic coatings; $R_9$ represents a hydrogen atom, an alkyl group, an aryl group; $R_{10}$ is a hydrogen atom, an alkyl group, —O—$R_{11}$ or —S—$R_{11}$ wherein $R_{11}$ is a hydrogen atom, an alkyl group, an aryl group, a heterocyclic group bonded to the oxygen or sulfur atom through one carbon forming said heterocyclic group, or an acyl group; $R_{12}$ is a hydrogen atom, an alkyl group, or an aryl group; and $R_{13}$ is a halogen atom or an alkoxy group.

5. A photographic element as claimed in claim 4, wherein the yellow dye-forming coupler is represented by the formula

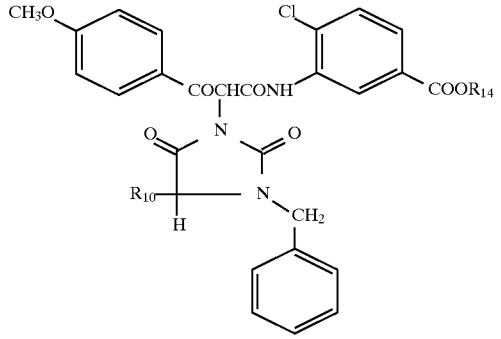

wherein $R_{10}$ is a hydrogen atom, an alkyl group, —O—$R_{11}$ or —S—$R_{11}$ wherein $R_{11}$ is a hydrogen atom, an alkyl group, an aryl group, a heterocyclic group bonded to the oxygen or sulfur atom through one carbon forming said heterocyclic group, or an acyl group, and $R_{14}$ is an alkyl group having 8 to 32 carbon atoms.

6. A photographic element as claimed in claim 1, wherein the yellow dye-forming coupler is used in an amount ranging from 0.01 to 0.5 mol per mol of silver halide, and the cyan dye-foriiiing coupler is used in an amount of 0.001 to 0.1 mol per mol of silver halide.

7. A photographic element as claimed in claim 1, wherein the yellow dye-forming coupler is represented by the formula

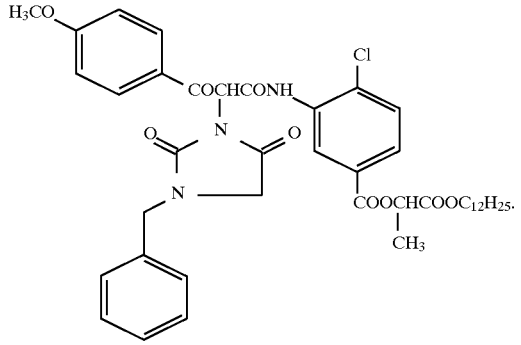

8. A photographic element as claimed in claim 1, wherein the cyan dye-forming coupler is represented by the formula

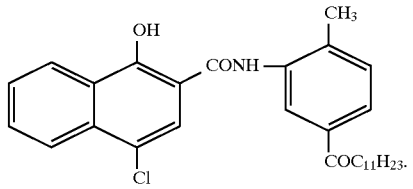

9. A photographic element as claimed in claim 1 comprising a support having coated thereon in the following order an antihalation layer, three layers of silver halide emulsions sensitized to red light of increasing sensitivity from the support and containing cyan dye-forming couplers, three layers of silver halide emulsions sensitized to green light of increasing sensitivity from the support and containing magenta dye-forming couplers, a yellow dye filter layer, and two layers of silver halide emulsions sensitized to blue light of increasing sensitivity from the support and containing yellow dye-forming couplers.

* * * * *